US005860444A

United States Patent [19]

Guendjoian et al.

[11] Patent Number: 5,860,444

[45] Date of Patent: Jan. 19, 1999

[54] AIR GAP BACKFLOW PREVENTION DEVICE

[76] Inventors: Armen Guendjoian; Beth Guendjoian, both of 291 Oregon La., Boca Raton, Fla. 33487

[21] Appl. No.: 932,382

[22] Filed: Sep. 17, 1997

Related U.S. Application Data

[63] Continuation-in-part of Ser. No. 585,107, Apr. 22, 1996, abandoned.

[51] Int. Cl.[6] ..... E03C 1/12

[52] U.S. Cl. ..... 137/216; 137/216.1

[58] Field of Search ..... 137/216, 216.1

[56] References Cited

U.S. PATENT DOCUMENTS

| | | | |
|---|---|---|---|
| 2,250,974 | 7/1941 | Stoddard | 137/216 |
| 3,066,691 | 12/1962 | Lengyel . | |
| 3,086,543 | 4/1963 | McAuley . | |
| 3,158,169 | 11/1964 | Smith . | |
| 3,183,923 | 5/1965 | Henrikson . | |
| 3,856,036 | 12/1974 | Drews et al. . | |
| 4,467,830 | 8/1984 | Hutchinson . | |
| 5,592,964 | 1/1997 | Traylor . | |
| 5,678,592 | 10/1997 | Boticki et al. | 137/216 |

*Primary Examiner*—Gerald A. Michalsky
*Attorney, Agent, or Firm*—Sixbey, Friedman, Leedom & Ferguson, PC; Stuart J. Friedman

[57] ABSTRACT

A backflow prevention device for connection between an equipment liquid drain line and a sewer connection, the device being operable to prevent backflow of sewer waste into the equipment, comprising: an inlet opening at its upper portion, the inlet opening being connected to the drain pipe of the equipment; b) an outlet opening at its lower portion, the outlet opening being connected to the sewer; c) an arcuate liquid flow conduit, including a discharge opening, in liquid flow communication with the inlet opening for receiving inlet waste flow therefrom and redirecting and discharging it through the discharge opening in a downward vertical direction; d) a tubular liquid flow conduit in liquid flow communication with the outlet opening, the tubular flow conduit having an axial opening extending vertically therethrough and including an upper rim surrounding the axial opening; and e) a vertical connector on the tubular liquid flow conduit for supporting the arcuate liquid flow conduit in vertical spaced relationship therewith with the discharge opening of the arcuate liquid flow conduit vertically spaced a predetermined distance from the upper rim of the tubular flow conduit and the center of the discharge opening vertically aligned with the center of the axial opening. Preferably, the arcuate liquid flow conduit comprises an arcuate pipe segment having a substantially horizontal inlet segment, a substantially vertical discharge segment and an elbow interconnecting the inlet and discharge segments for redirecting inlet liquid waste flow through an arc of about ninety degrees.

9 Claims, 2 Drawing Sheets

AIR GAP BACKFLOW PREVENTION DEVICE

CROSS REFERENCE TO RELATED APPLICATIONS

This application is a continuation-in-part of application Ser. No. 08/585,107, filed Apr. 22, 1996, now abandoned.

BACKGROUND OF THE INVENTION

1. Field of the Invention

The present invention relates generally to backflow prevention devices and, more particularly, to a plumbing fixture for connection between a sewer connection and an appliance or equipment drain line for preventing backflow by interposing an air gap therebetween.

2. Description of the Prior Art

There is an inherent danger in connecting the drains of equipment or appliances directly to a sewer system. This is because some condition might occur which permits the backflow of sewer fluids through the drain lines into the equipment to contaminate it. For this reason many governmental entities have established codes that must be complied with before an equipment drain can be connected to a sewer system. Such codes commonly require that a device be inserted between each equipment drain line and the sewer system to prevent backflow. Such backflow can be caused, in the case of an equipment drain line, by an unexpected increase in liquid pressure in the sewage system or an unexpected decrease of liquid pressure at the drain line. In either case there is the possibility that highly contaminated sewage could be drawn into equipment connected to the drain line.

In particular, equipment used in restaurants, hospitals, supermarkets and industry typically drain their waste liquids through drain lines into the building drainage system which is connected to the public sewer system. Most plumbing codes require these equipment drain lines to be indirect drain lines, i.e., they may not connect directly with the building drainage system or the public sewer system. Rather, the drain lines must dispose of their liquid wastes by discharging into a plumbing fixture which itself is directly connected to the building drainage or public sewer systems. The plumbing fixture must generally provide an air gap between the equipment drain line and the drain standpipe or hub which is connected to the building drainage or public sewage systems.

Attempts to provide such backflow protective devices have focused on relatively complicated devices, such as valves which have numerous moving parts capable of being fouled by solids in the discharged liquids. Other proposed devices include baffled chambers requiring machined parts and/or close tolerances, all of which are impractically expensive for most applications. Even those devices which appear to be relatively simple require assembly of several parts and/or several threaded connectors, which make them uneconomical for the numerous everyday discharge connections such as might be encountered from supermarket freezer drains, soda machine drains, and the like. What is required for most day-to-day applications is a device in which the air gap is pre-set and which is truly simple, one-piece, capable of injection molding to facilitate production at low unit costs, devoid of moving parts and inherently incapable of failing to operate to prevent backflow.

SUMMARY OF THE INVENTION

It is therefore a primary object of the present invention to provide a backflow prevention device which is inexpensive to manufacture, simple, has no moving parts and which is easily installed.

It is also an object of the present invention to provide a backflow prevention device which operates by interposing a pre-set air gap between the equipment discharge line and the sewer system.

It is another object of the present invention to provide such a backflow prevention device which is readily formed in a single piece by injection molding to facilitate production and reduce costs.

It is still another object of the present invention to provide an air gap type backflow prevention device that is adaptable for connection with different size discharge lines and sewer system connectors.

The foregoing and other objects are achieved in accordance with the present invention by providing a backflow prevention device for connection between the liquid drain line from an item of equipment and a sewer connection, the device being operable to prevent backflow of sewer waste into the equipment, comprising: an inlet opening at its upper portion, the inlet opening being connected to the drain pipe of the equipment; b) an outlet opening at its lower portion, the outlet opening being connected to the sewer; c) arcuate liquid flow conduit means, including a discharge opening, in liquid flow communication with the inlet opening for receiving inlet waste flow therefrom and redirecting and discharging it through the discharge opening in a downward vertical direction; tubular liquid flow conduit means in liquid flow communication with the outlet opening, the tubular flow conduit means having an axial opening extending vertically therethrough and including an upper rim surrounding the axial opening; and e) connector means on the tubular liquid flow conduit means for supporting the arcuate liquid flow conduit means in vertical spaced relationship therewith with the discharge opening of the arcuate liquid flow conduit means vertically spaced a predetermined distance from the upper rim of the tubular flow conduit means and the center of the discharge opening vertically aligned with the center of the axial opening. Preferably, the arcuate liquid flow conduit means comprises an arcuate pipe segment having a substantially horizontal inlet segment, a substantially vertical discharge segment and an elbow interconnecting the inlet and discharge segments for redirecting inlet liquid waste flow through an arc of about ninety degrees. Desirably, one or more ribs extend between the vertical connector and the arcuate pipe segment for stabilizing and rigidifying the pipe segment.

DESCRIPTION OF THE PREFERRED EMBODIMENT

Figure 1:
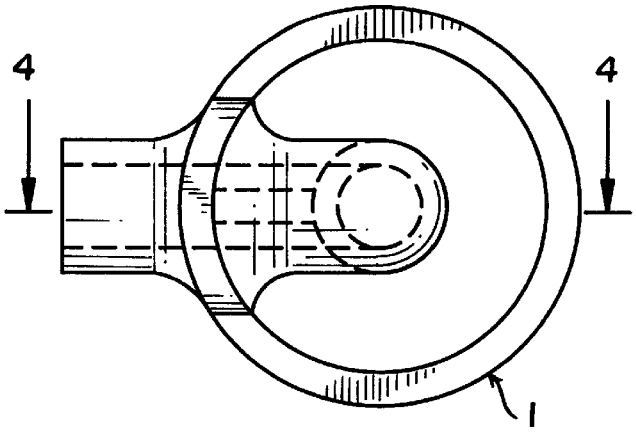
FIG. 1 is a plan view of the backup prevention device of the present invention.
Figure 2:
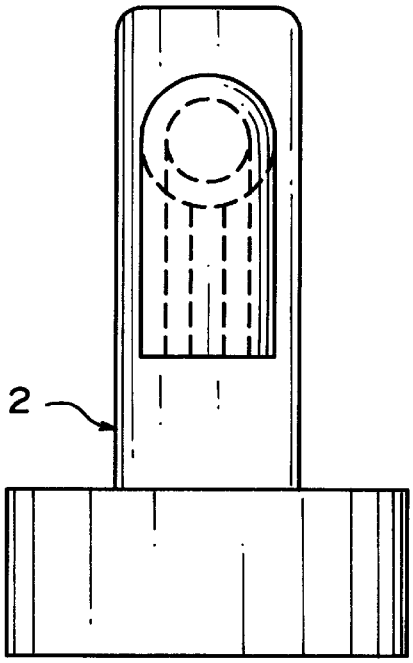
FIG. 2 is a right side view of the backup prevention device of FIG. 1.
Figure 4:
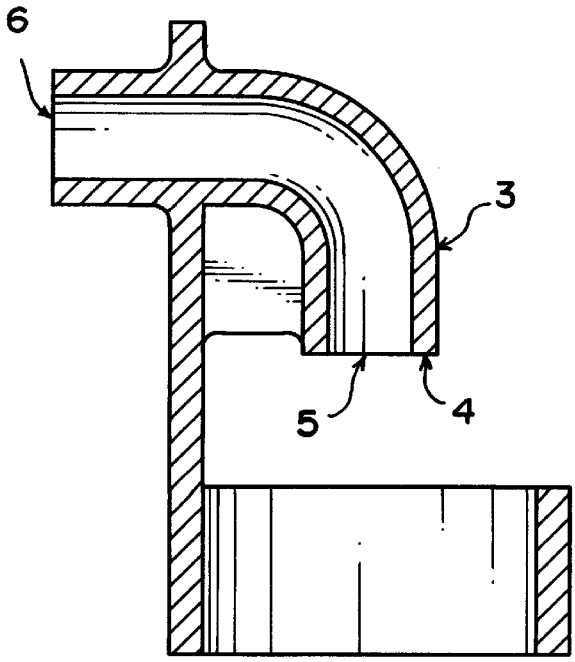
FIG. 4 is a sectional view taken along line 4—4 in FIG. 1.
Figure 3:
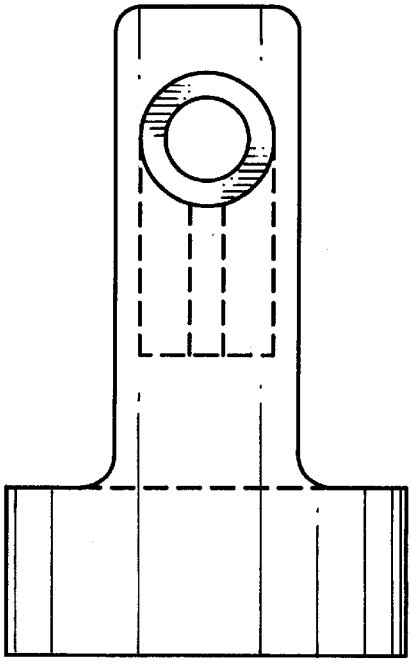
FIG. 3 is a left side view of the backup prevention device of FIG. 1.
Figure 5:
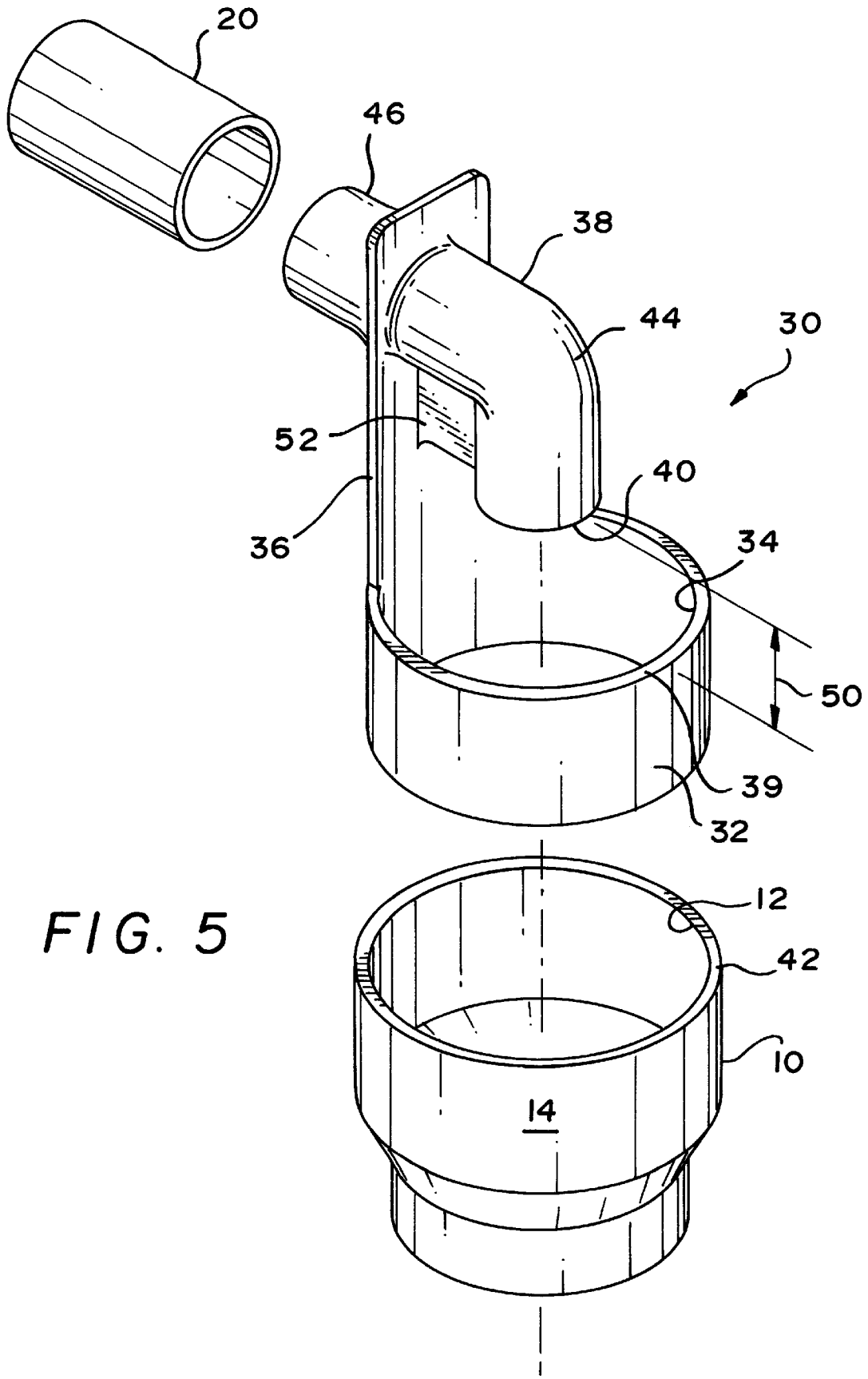
FIG. 5 is a perspective view of the backup prevention device of FIG. 1 shown in conjunction with an exemplary equipment drain line and an exemplary sewer connection.

Referring to FIG. 5 there is shown a drainage or sewage system hub 10 that is connected to or integrally formed with a drainage or sewage system (not shown) at its lower end. Air gap backflow prevention device 30 of the present invention fits within a central opening 12 in cylindrical body 14 of hub 10 and is liquid tightly connected thereto in conventional manner, such as by use of adhesives, threads, and the like. Also shown is the discharge end of waste drain line 20 which extends from an item of equipment or an appliance which drains or discharges liquid therefrom. It will be understood that drain line 20 may extend from various items of equipment or appliances customarily found in commercial establishments, industry and the home.

Air gap backflow prevention device 30 is preferably unitary and integrally formed, e.g., by injection molding, and is typically formed of an inexpensive plastic useful in plumbing applications, such as polyvinylchloride (PVC). Use of this type material permits the device to be adhesively, or otherwise, liquid tightly connected to drain line 20 and hub 10 in conventional manner. Device 30 comprises a lower cylindrical tube 32 having an outside diameter of a predetermined dimension so as to fit snugly into the central opening 12 of hub 10 with its upper rim 39 at or below the level of hub upper rim 42. Axial opening 34 in tube 32 desirably has a diameter slightly smaller than the internal diameter of central opening 12 so as to provide an unobstructed flow path for the drain liquid from device 30 into hub 10 and the discharge system. Vertical connector 36 supports, in cantilevered fashion, downwardly arcuate pipe segment 38 in spaced relationship with the upper rim 39 of tube 32 and vertically aligned with the central axis of tube 32. In this way a pre-set vertical air gap 50 is defined between the discharge opening 40 of arcuate pipe segment 38 and the overflow or upper rim 42 of hub 10. To facilitate escape of sewage waste in the event of a backup, the air gap 50 extends substantially completely around the circumferential extent of overflow or upper rim 42 of hub 10. At the same time, discharge opening 40 is fixed in a position which maintains it coaxial with axial central opening 32 of tube 32. Desirably, vertical connector 36 has only a small circumferential extent along upper rim 39, e.g., less than about 30 degrees, in order that air gap 50 may provide an overflow volume which is circumferentially as large as possible. A support rib 52 is formed preferably integrally with and extends between vertical connector 36 and pipe segment 38 for stabilizing and rigidifying the pipe segment 38 against vibration and movement due to the flow of waste liquid therethrough. This arrangement contributes to the integrity of the connection between the pipe segment 38 and vertical connector 36 and facilitates the manufacture of the backflow prevention devices 30 by cost reduction methods, such as injection molding.

Vertical connector 36 also supports pipe stub 46 which projects therefrom in the direction opposite to pipe segment 38. Arcuate pipe segment 38 is coaxial with pipe stub 46 which, in turn, is liquid tightly connected to drain line 20. If the dimensions of the pipe stub 46 and drain line 20 (or the tube 32 and hub 10) do not permit direct connection to each other, pipe connection adapters, extensions and the like may be used, as needed, to effect the interconnection. An elbow segment 44 of arcuate pipe segment 38 redirects the waste flow from drain line 20 through inlet pipe stub 46 through an arc of about ninety degrees. In this manner drain liquid, through typically horizontally disposed equipment drain line 20, is made to flow in a vertical direction through discharge opening 40, air gap 50 and tube 32 into the sewer system. Particularly when drain line 20 carries waste liquid under pressure, redirection of the waste flow through arcuate pipe segment 38 effectively aims the waste liquid at the coaxial centers of tube 32 and hub 10 to help diminish splashing without need for expensive baffling or flow control devices.

In the operation of the installed backflow prevention device 30, liquid waste passes from the equipment through drain line 20, through pipe stub 46 and arcuate pipe segment 38 of the backflow prevention device 30 of the present invention, through air gap 50 and tube 32 into hub 10 of the sewer system. Should the sewer system downstream of hub 10 become clogged so that the waste liquid cannot flow therethrough, or in the event of a low pressure condition upstream of backflow prevention device 30, waste liquid will back up through the sewer system into hub 10 and the axial opening 34 of tube 32. However, the waste liquid cannot back up past the overflow or upper rim 42 of hub 10 since, once it passes overflow rim 42, the waste liquid will escape from hub 10 through large volume air gap 50. This prevents the waste liquid from backing up into drain line 20 and the equipment from which it extends. Thus, sewage liquid contamination of the equipment connected to drain line 20 is avoided.

From the foregoing it can be seen that the backflow prevention device 30 of the present invention functions to provide a positive safeguard against the possibility of sewer liquids backflowing into the equipment being protected by device 30. Accordingly, it is not possible for backflow waste liquid to reach or pass through discharge opening 40, arcuate pipe segment 38, pipe stub 46 or drain line 20. Moreover, whenever the clogged drainage system is cleared or the low pressure condition is resolved, the backflow prevention device 30 is immediately ready for normal operation with flow from the discharge opening 40 through the air gap 50 into tube 32 and hub 10 without need for cleaning, resetting, or other action by the user.

Backflow prevention devices made in accordance with the present invention are economical to manufacture at low unit costs, efficient and practical in operation and satisfy the requirements of municipal codes requiring indirect drain line connections between draining or discharging equipment and the sewer system. Thus, it will be appreciated that the present invention provides a simple, effective, inexpensive and practical fixed air gap-type backflow prevention device for equipment which drains or discharges waste liquid to the public sewage system.

While the present invention has been described in terms of specific embodiments thereof, it will be understood that no limitations are intended to the details of construction or design other than as defined in the appended claims.

We claim:

1. A backflow prevention device for connection between the liquid drain line from an item of equipment and a sewer connection, said device being operable to prevent backflow of sewer waste into said equipment, comprising:

a) an inlet opening at its upper portion, said inlet opening being connected to the drain pipe of said equipment;

b) an outlet opening at its lower portion, said outlet opening being connected to said sewer;

c) arcuate liquid flow conduit means, including a discharge opening, in liquid flow communication with said inlet opening for receiving inlet waste flow therefrom and redirecting and discharging it through said discharge opening in a downward vertical direction, said arcuate liquid flow conduit means comprising an arcuate pipe segment having a substantially horizontal inlet segment, a substantially vertical discharge segment and an elbow interconnecting said inlet and discharge segments for redirecting inlet liquid waste flow through an arc of about ninety degrees;

d) tubular liquid flow conduit means in liquid flow communication with said outlet opening, said tubular flow conduit means having an axial opening extending vertically therethrough and including an upper rim surrounding said axial opening; and e) connector means on said tubular liquid flow conduit means for supporting said arcuate liquid flow conduit means in vertical spaced relationship therewith with said discharge opening of said arcuate liquid flow conduit means vertically spaced a predetermined distance from said upper rim of said tubular flow conduit means and the center of said discharge opening vertically aligned with the center of said axial opening, said connector means comprising a vertically disposed support projecting upwardly from said upper rim into supporting relationship with said arcuate liquid flow conduit means for supporting said arcuate liquid flow conduit means in a cantilevered fashion;

f) wherein said arcuate pipe segment vertical connector and tubular liquid flow conduit means are unitary and formed integrally.

2. A backflow prevention device, as claimed in claim 1, wherein said connector means contacts said upper rim along an angular distance less than about 30 degrees of the circumferential extent of said rim.

3. A backflow prevention device, as claimed in claim 1, wherein said arcuate liquid flow conduit means is circular in cross section.

4. A backflow prevention device, as claimed in claim 3, wherein said tubular liquid flow conduit means is circular in cross section.

5. A backflow prevention device, as claimed in claim 4, further including rib means extending between said connector means and said arcuate pipe segment for stabilizing and rigidifying said pipe segment.

6. A backflow prevention device, as claimed in claim 5, wherein said arcuate pipe segment is supported by said connector means in a extends from said connector means in a direction such that the center of said discharge opening is vertically aligned with the center of said axial opening and further including a pipe stub in liquid flow communication with said arcuate pipe segment and supported by said connector means, said pipe stub extending from said connector means in the direction opposite to the direction of said arcuate pipe segment.

7. A backflow prevention device, as claimed in claim 6, wherein said inlet opening comprises the inlet opening to said pipe stub.

8. A backflow prevention device, as claimed in claim 7, wherein said pipe stub, arcuate pipe segment, rib means, vertical connector and tubular liquid flow conduit means are unitary and formed integrally.

9. A backflow prevention device, as claimed in claim 8, wherein said device is formed of polyvinylchloride.

* * * * *